United States Patent [19]

Utz et al.

[11] 4,220,123

[45] Sep. 2, 1980

[54] SUBPRESSURE LIMITER FOR A FUEL INJECTION SYSTEM

[75] Inventors: Eberhard Utz, Stuttgart; Siegfried Fehrenbach, Markgrönigen; Dittmar Klett, Pleidesheim; Richard Bertsch, Asperg; Heinrich Knapp, Leonberg, all of Fed. Rep. of Germany

[73] Assignee: Robert Bosch GmbH, Stuttgart, Fed. Rep. of Germany

[21] Appl. No.: 802,331

[22] Filed: Jun. 1, 1977

[30] Foreign Application Priority Data

Jun. 4, 1976 [DE] Fed. Rep. of Germany ..... 2626141

[51] Int. Cl.[2] ..... F02M 7/12

[52] U.S. Cl. ..... 123/327; 123/587

[58] Field of Search ..... 123/124 R, 103 R, 119 D, 123/97 B; 261/DIG. 19, 39 A

[56] References Cited

U.S. PATENT DOCUMENTS

| | | | |
|---|---|---|---|
| 2,297,231 | 9/1942 | Lichte | 261/39 A |
| 2,389,219 | 11/1945 | Thompson | 261/39 A |
| 2,824,726 | 2/1958 | Dietrich et al. | 261/DIG. 19 |
| 2,981,279 | 4/1961 | Beck | 261/DIG. 19 |
| 3,011,770 | 12/1961 | Stoltman | 261/39 A |
| 3,370,577 | 2/1968 | Guetersloh | 123/103 R |
| 3,841,282 | 10/1974 | Rogerson | 123/124 R |
| 3,852,391 | 12/1974 | Hisatomi | 261/DIG. 19 |

FOREIGN PATENT DOCUMENTS

| | | | |
|---|---|---|---|
| 2258551 | 6/1973 | Fed. Rep. of Germany | 123/119 D |

*Primary Examiner*—Ronald H. Lazarus
*Attorney, Agent, or Firm*—Edwin E. Greigg

[57] ABSTRACT

The invention relates to a subpressure limiter for a fuel injection system of a mixture compressing, externally ignited internal combustion engine wherein the apportioned fuel quantity is injected into the suction tube containing an arbitrarily actuatable throttle valve, and wherein the suction tube sections upstream and downstream of the throttle valve are interconnected by means of a bypass whose cross-sectional area is variable by means of the subpressure limiter and features a pressure dependent control element responding to the subpressure prevailing within the suction tube section downstream of the throttle valve during an overrunning operation.

11 Claims, 5 Drawing Figures

2
37
41
43
42
44
26
25
27
24
6
4
7
22
3
1
20
12
13
11
15
39
10
14
16
18
19
40
5
21
9
8

SUBPRESSURE LIMITER FOR A FUEL INJECTION SYSTEM

BACKGROUND OF THE INVENTION

It is already well-known to have subpressure limiters which respond to the pressure drop created by the sudden closure of the throttle valve during overrunning and which conduct an air quantity around the closed throttle valve sufficient to maintain combustion in the individual cylinders of the combustion engine during overrunning. However, such subpressure limiters are not suited to ensure the correct apportionment of the overrunning air at differing geodetic altitudes, since, during overrunning, in responding to the pressure differential upstream and downstream of the throttle valve at increased altitudes and their consequent lower atmospheric pressure, they open only at excessive subpressures downstream of the throttle valve.

OBJECT AND SUMMARY OF THE INVENTION

Accordingly, it is the primary object of the invention to develop a subpressure limiter of the general type described above in which the correct apportionment of the overrunning air shall be assured independent of the given atmospheric pressure (altitude).

According to the invention, this objective is achieved by the fact that the pressure dependent control element is constructed as an evacuated elastic hollow body disposed within a chamber which communicates with the suction tube section downstream of the throttle valve and further that a control valve is actuatable by means of the control element.

According to a further object of the invention, a pressure-responsive capsule serves as the evacuated elastic hollow body and the subpressure limiter is formed by means of a pre-control capsule and a bypass control capsule, and in addition, the pressure-responsive capsule and the control valve are situated in the chamber of the pre-control capsule.

A further advantageous embodiment of the invention resides in the fact that the housing of the bypass control capsule is subdivided by means of a diaphragm into two chambers, the first chamber of which is connected via a first line to the suction tube section upstream of the throttle valve and via a second line to the suction tube section downstream of the throttle valve. In addition, the second line is closable by means of a movable valve component which thrusts against the diaphragm, the arrangement being such that the second chamber communicates on the one hand via a throttle with the first chamber and on the other hand communicates via the control valve with the pre-control capsule and contains a soft pressure spring which biases the diaphragm toward the direction of closure of the movable valve component. Further, the control valve features a rod-like closure body, one end of which is constructed in the form of a truncated cone that is arranged to cooperate with a fixed valve seat and a spring which biases the closure body toward the direction of the closure of the control valve acts via a perforated disk upon the spherically constructed other end of the closure body, with the spring, the perforated disk, and the closure body of the control valve being longitudinally enclosed by means of a sleeve and the spherical end of the closure body arranged to protrude from the sleeve in the direction toward the pressure-responsive capsule.

In yet another advantageous embodiment of the invention, the pressure-responsive capsule includes a disk which cooperates with the spherical end of the control valve closure body with the closure body of the control valve being movable toward the opened direction of the control valve by means of the pressure-responsive capsule via the disk in the presence of a subpressure in the suction tube section downstream of the throttle valve characterizing the overrunning of the combustion engine, while at the same time, the disk is pressed against the sleeve by means of the pressure-responsive capsule in the event the pressure-responsive capsule develops a leak.

Still another advantageous embodiment of the invention resides in the axial position of the pressure-responsive capsule in the pre-control capsule being adjustable by means of a screw.

In still another advantageous embodiment of the invention the coiled spring of the control valve remote from the perforated disk is provided with a cant so that the perforated disk touches the inner wall of the sleeve.

In yet a further advantageous embodiment of the invention the pre-control capsule and the second chamber of the bypass control capsule are interconnected by means of a connecting hose.

In still another advantageous embodiment of the invention a bellows serves as the evacuated elastic hollow body, which is located within a chamber connected to the suction tube sections upstream and downstream of the throttle valve, with the bellows being arranged to control a movable valve component that determines the cross-sectional throughflow area of the line leading to the suction tube section upstream of the throttle valve.

The invention will be better understood as well as further objects and advantages thereof become more apparent from the ensuing detailed description of three preferred exemplary embodiments taken in conjunction with the drawings.

DESCRIPTION OF THE PREFERRED EMBODIMENTS

Figure 1:
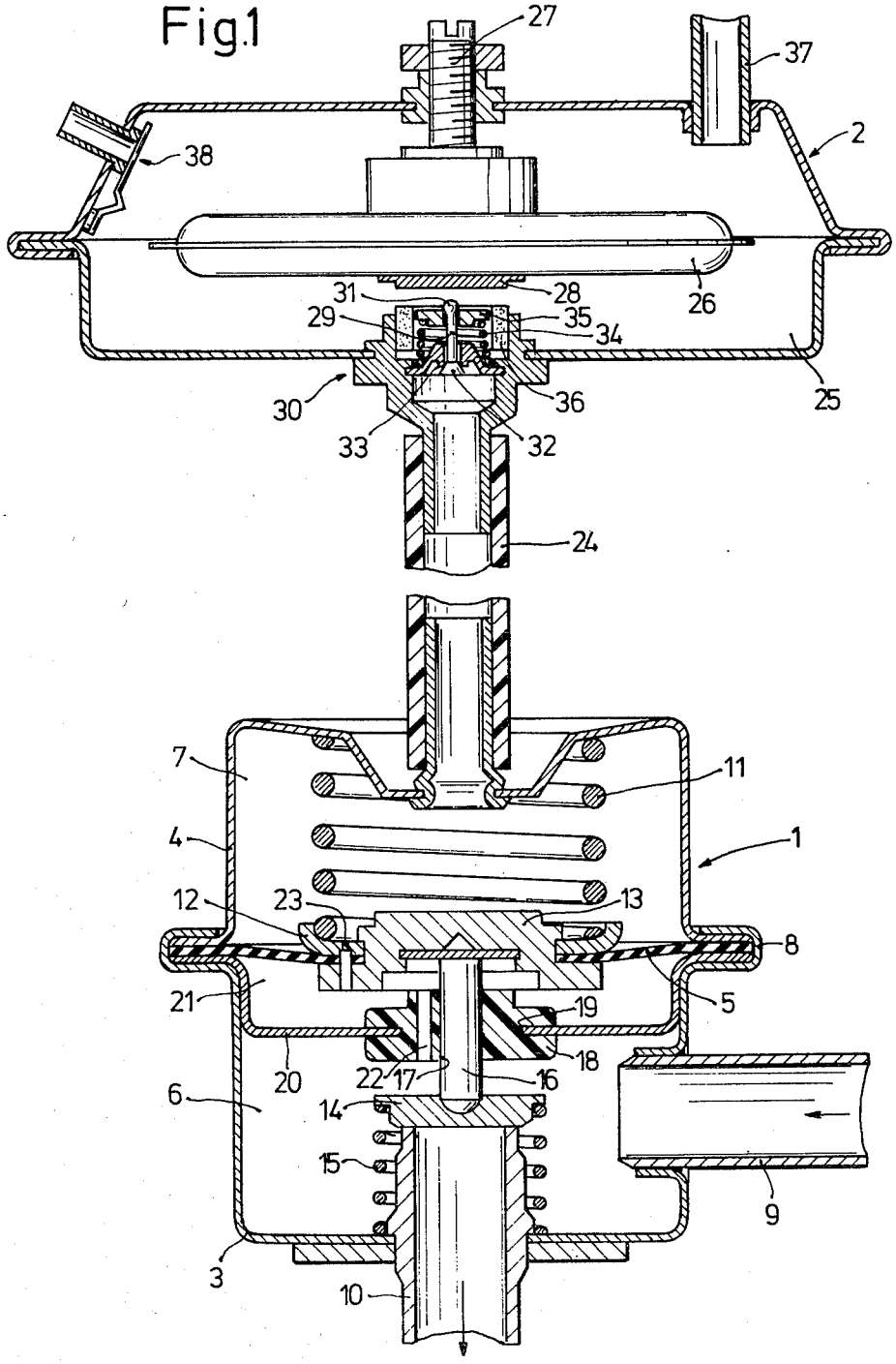
FIG. 1 is a cross-sectional view of a first exemplary embodiment of a subpressure limiter.

Turning now to the drawings, FIG. 1 represents a first exemplary embodiment of a subpressure limiter having a bypass control capsule 1 and a pre-control capsule 2. The bypass control capsule 1 includes a housing composed of two deep-drawn housing parts 3 and 4 which are subdivided into a first chamber 6 and a second chamber 7 by means of a diaphragm 5. The diaphragm 5 is captively secured at the flanged rim 8 that joins the two housing parts 3 and 4.

Figure 5:
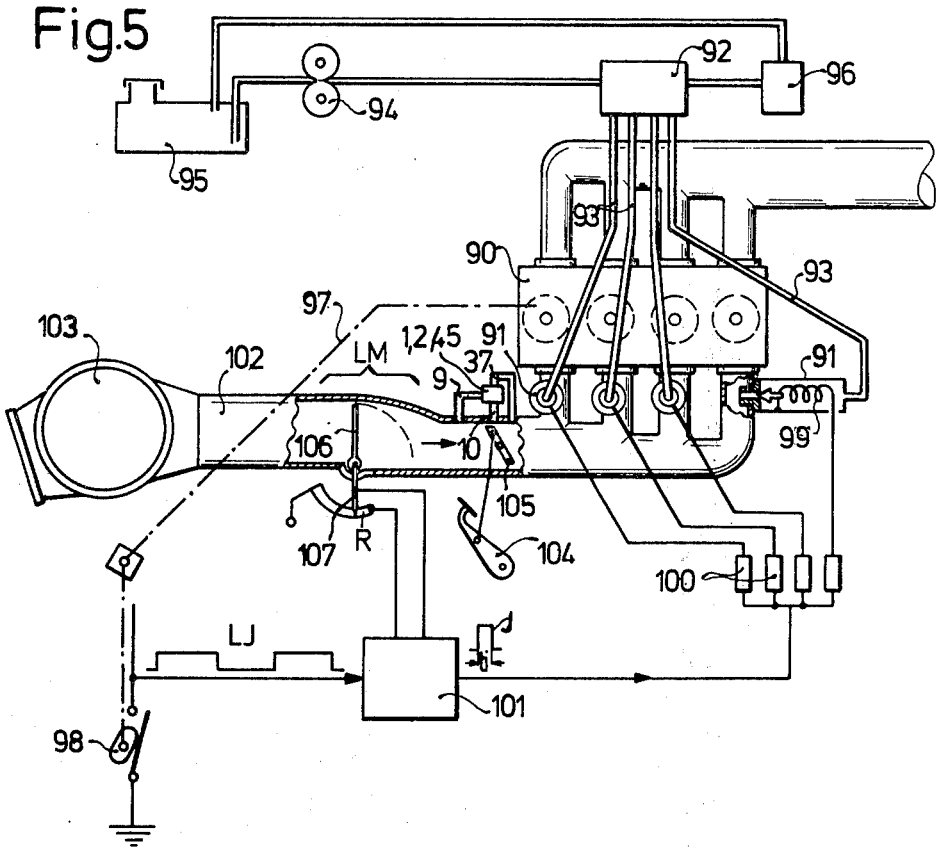
FIG. 5 is a schematic view of a mechanical fuel injection system provided with a subpressure limiter.
Figure 4:
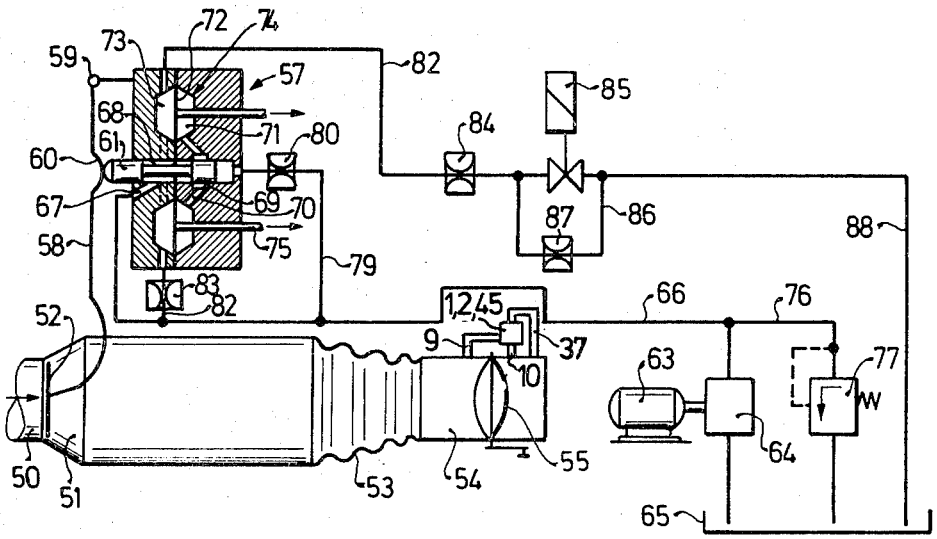
FIG. 4 is a schematic view of an electrically controlled fuel injection system provided with a subpressure limiter.

The first chamber 6 of the bypass control capsule 1 connects via a first line 9 to the suction tube section upstream of the throttle valve in the intake tube of the internal combustion engine and connects via a second line 10 to the suction tube section downstream of the throttle valve (see FIGS. 4 and 5). The second chamber 7 contains a soft pressure spring 11, one end of which presses against the housing base of the housing part 4, while its other end presses against a spring support dish 12. The spring support dish 12 is centrally affixed to a reinforcing disk 13 that coaxially penetrates the diaphragm 5 and, if desired, can comprise a rubberized fabric diaphragm.

The first chamber 6 contains a dish-like movable valve component 14 that cooperates with a sealing seat which is formed by the terminus of the plane-ground surface of the second line 10 that protrudes into the first chamber 6. This end section of the second line 10 is surrounded by a restoring spring 15 that presses on one side against the base of the housing part 3 and on the other side against the movable valve component 14 and thus tends to lift the movable valve component 14 off its seat. A pressure pin 16 is fitted without play between the reinforcing disk 13 carried by the diaphragm 5 and the movable valve component 14, in order to link the axial motion of the valve and of the diaphragm 5. A pressure pin 16 is longitudinally displaceable within a longitudinal bore 17 of a hub 18 which comprises, for example, a nylon grommet injection molded into a central opening 19 of a partition 20. The partition 20 is deep-drawn from sheet steel and is captively secured at its flange-like rim by the flanged rim 8, together with the diaphragm 5. The function of the partition 20 is to prevent the oscillatory float of the system, and includes two springs 11 and 15 and of the masses of the valve component 14, the pressure pin 16, the reinforcing disk 13 and the spring dish 12, under the influence of pressure fluctuations occurring primarily at low engine rpm in the operation of the intake system of the internal combustion engine. In order that the pressure prevailing in the first chamber 6 is only slightly lower than the atmospheric pressure and can be fully effective upon the diaphragm 5, a connecting passage is provided between the first chamber 6 and the intermediate chamber 21 separated therefrom by the partition 20. An equalizing bore 22 is provided in the hub 18, having a diameter of approximately 1 millimeter and serves as the connecting passage. The intermediate chamber 21 is in turn connected with the second chamber 7 via a throttle bore 23 that is provided in the dish 12 and the disc 13.

The pre-control capsule 2 and the bypass control capsule 1 can be positively connected, but can also be separately disposed as shown in the drawing and then interconnected via a connecting hose 24. The chamber 25 of the pre-control capsule 2 contains an evacuated elastic hollow body constructed in the form of a pressure-responsive capsule 26, the axial position of which is adjustable in the chamber 25 by means of a screw 27 that penetrates the wall of the pre-control capsule 2. The side of the pressure-responsive capsule 26 remote from the screw 27 includes a disk 28 that cooperates with a rod-like closure body 29 of a control valve 30. The rod-like closure body 29 has a spherical end 31 arranged to abut the disk 28 and a truncated conical end 32 that cooperates with a fixed valve seat 33. The rod-like closure body 29 is biased to close by means of a spring 34 that acts upon the spherical end 31 of the closure body 29 via the perforated disk 35. The spring 34, the perforated disk 35, and the closure body 29 are surrounded by means of a sleeve 36 in such a way that the spherical end 31 of the closure body 29 protrudes from the sleeve 36 toward the pressure-responsive capsule 26. It is particularly advantageous to construct the end of the spring 34 remote from the perforated disk 35 so as to cause the spring to cant or tilt and thereby to cause the perforated disk 35 to touch the inner wall of the sleeve 36 and be in frictional engagement therewith. In this manner high frequency and acoustically disturbant oscillations are thereby prevented.

The chamber 25 of the pre-control capsule 2 is connected on the one hand via a line 37 to a suction tube section downstream of the throttle valve and on the other hand is connected via the control valve 30 and the connecting hose 24 to the second chamber 7 of the bypass control capsule 1.

In order to signal a possible failure of the subpressure limiter, a reed whistle 38, for example, could be incorporated in the pre-control capsule 2 and could provide an audible signal whenever the suction tube pressure downstream of the throttle valve becomes excessively large. Another signalling possibility would be, for example, to equip the upper exposed surface of the sleeve 36 and the opposing lower surface of the disk 28 with electrical contacts that are connected to an indicator device on the instrument panel of the motor vehicle. In such an arrangement the indicator device would then respond whenever the two contacts are engaged.

The operation of the subpressure limiter depicted in FIG. 1 is as follows:

The axial position of the pressure-responsive capsule 26 in the chamber 25 of the pre-control capsule 2, relative to the spherical end 31 of the movable closure body 29 of the control valve 30, is set in such a way by means of the screw 27, that the disk 28 of the pressure-responsive capsule 26 does not touch the spherical end 31 of the closure body 29 under the force of the subpressure occurring in the intake tube downstream of the throttle valve during normal running operation or during engine idling and consequently the control valve 30 remains closed. However, during an overrunning engine speed, the pressure in the intake tube downstream of the throttle valve falls, which also causes the pressure in the chamber 25 to fall, so that the pressure-responsive capsule 26 opens the closure body 29 of the control valve 30 via the disk 28, for example, at an absolute pressure of approximately 300 torr units. When the control valve 30 is open, the pressure in the second chamber 7 of the bypass control capsule 1 now falls and the diaphragm 5 moves toward the base of the housing part 4, so that the restoring spring 15 lifts the movable valve component 14 off its seat and air can now flow, through the developing annular slit at the cooperating second line 10, via the first line 9 into the second line 10 downstream of the throttle valve, thus ensuring the continually adequate combustion process of the internal combustion engine in spite of strong throttling. When the absolute pressure downstream of the throttle valve again rises to a preset value, adjustable by means of the screw 27 via the pressure-responsive capsule 26, the disk 28 of the pressure-responsive capsule 26 and the closure body 29 are moved apart, and thus prevented from interacting, and the control valve 30 closes due to the force of the spring 34. Pressure equalization now takes place, via the equalizing bore 22 and the throttle bore 23, between the chambers 6 and 7 of the bypass control capsule 1, so that the movable valve 14 closes from the force of the soft spring 11. The pre-set suction tube subpressure, downstream of the throttle valve, at which the movable valve 14 of the bypass control capsule 1 opens, is thus not determined by the force of the spring 11, as is the case with known subpressure limiters; in this design rather the spring force serves solely to keep the movable valve 14 in its position of closure when the control valve 30 is closed. In the subpressure limiter disclosed in this application, the subpressure at which the movable valve 14 lifts off its seat is determined by that subpressure, downstream of the throttle valve, at which the control valve 30 is opened by means of the pressure-responsive capsule 26, the axial displacement of which is pre-set by means of the screw 27 to produce the desired subpressure level. In order to prevent the control valve 30 from remaining continuously open, in the event of the pressure-responsive capsule 26 developing a leak, and thus cause the movable valve 14 likewise to lift off its seat and to continuously admit air into the suction tube via the second line 10, the control valve 30 is surrounded by the sleeve 36 against which the disk 28 presses thus blocking the flow cross section of the control valve 30.

Figure 2:
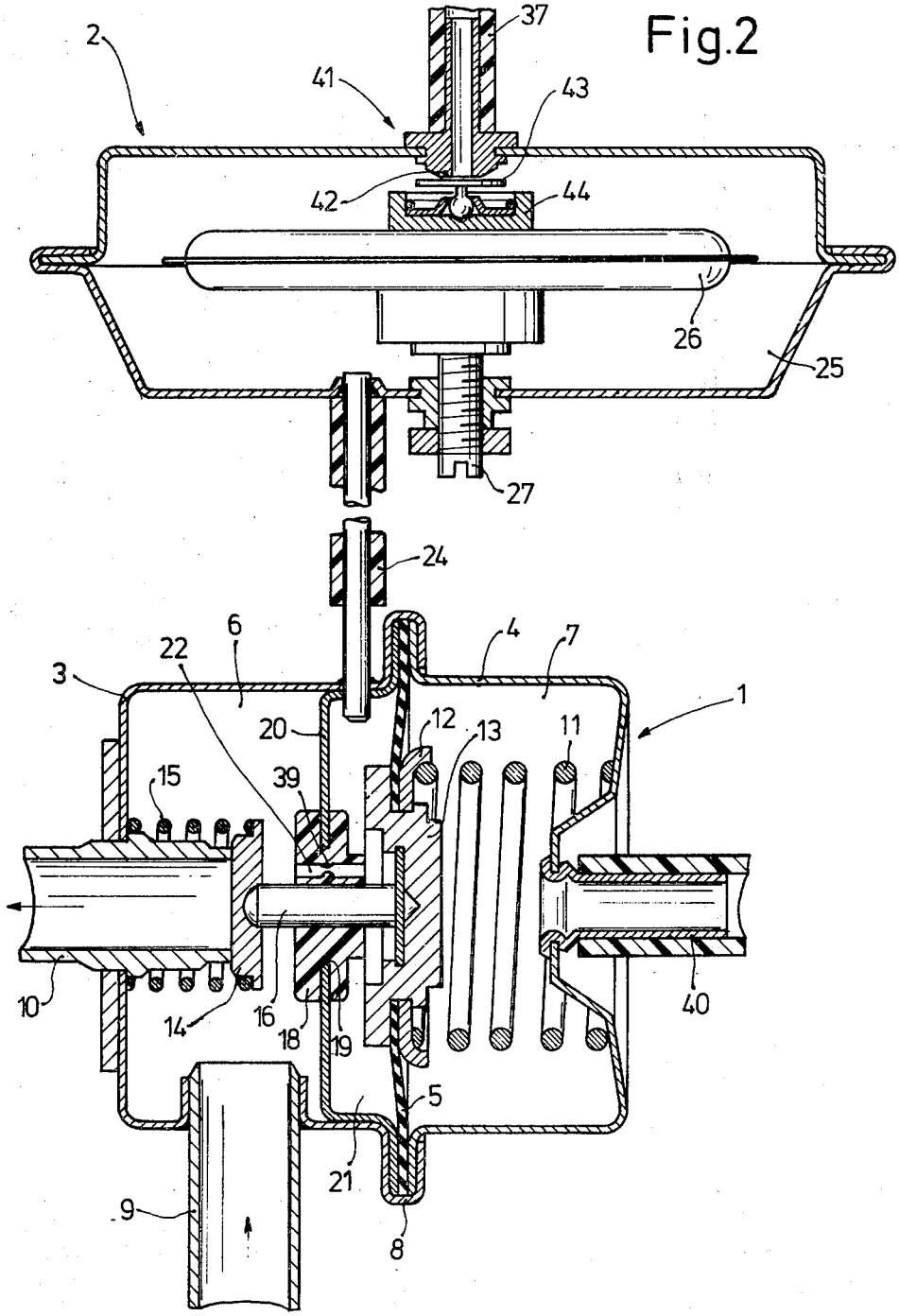
FIG. 2 is a cross-sectional view of a second exemplary embodiment of a subpressure limiter.

In the second exemplary embodiment of a subpressure limiter depicted in FIG. 2, corresponding parts relative to the subpressure limiter shown in FIG. 1 receive the same respective reference numerals. The subpressure limiter in this embodiment differs from that of FIG. 1 essentially in that a restrictor 39 is provided in the equalizing bore 22 connecting the first chamber 6 to the intermediate chamber 21 of the bypass control capsule 1, and in that no connection exists between the first chamber 6 and the second chamber 7. The second chamber 7 connects to the suction tube section downstream of the throttle valve via a third line 40. In the second embodiment, the connecting conduit between the pre-control capsule 2 and the bypass control capsule 1 leads into the intermediate chamber 21 of the bypass control capsule 1. The line 37, which leads from the suction tube section downstream of the throttle valve to the chamber 25 of the pre-control capsule 2, is closable by means of a control valve 41, formed by a valve seat 42 and a valve 43 which can, as depicted in FIG. 2, be universally tiltable in a mounting 44 attached to the pressure-responsive capsule 26.

The operation of the subpressure limiter depicted in FIG. 2 is as follows:

During the normal running operation and during the idling operation of the engine, the control valve 41 of the control capsule 2 is open and the subpressure prevailing in the suction tube section downstream of the throttle valve is communicated to the intermediate chamber 21 via the connecting conduit 24 and into the second chamber 7 of the bypass control capsule 1 via line 40. When the subpressure in the suction tube section downstream of the throttle valve reaches a value coincident with the overrunning operation of the engine, then the pressure-responsive capsule 26 moves the valve 43 in the direction of the valve seat 42, thus closing the control valve 41. Whereupon the atmospheric pressure from the first chamber 6 is communicated to the intermediate chamber 21 of the bypass control capsule 1 via the equalizing bore 22 and the restrictor 39, and as a consequence the force of the spring 11 is overcome due to the pressure differential on the diaphragm 5, and the restoring spring 15 lifts the movable valve 14 off its seat, so that air can now flow via the second line 10 into the suction tube section downstream of the throttle valve. The pressure now prevailing in the intermediate chamber 21 also is communicated via the connecting conduit 24 to the chamber 25 of the pre-control capsule 2, so that the control valve 41 is now opened by means of the pressure-responsive capsule 26. If a subpressure coincident to that occurring in the overrunning engine operation still prevails in the suction tube section downstream of the throttle valve, then the pressure-responsive capsule 26 resultantly closes the control valve 41 again. As is the case for the embodiment of FIG. 1, in the embodiment according to FIG. 2 the force of the spring 11 does not determine the subpressure level downstream of the throttle valve at which air is conducted, during the overrunning engine operation, via the second line 10 to the suction tube section downstream of the throttle valve. In similar fashion to the embodiment of FIG. 1, the subpressure level downstream is pre-set by means of the screw 27 adjusting the pressure-responsive capsule 26.

Figure 3:
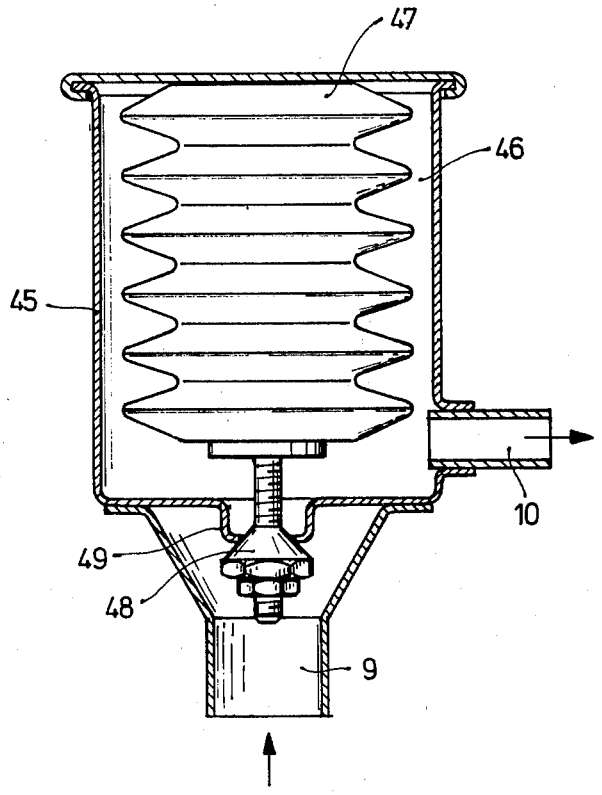
FIG. 3 is a cross-sectional view of a third exemplary embodiment of a subpressure limiter.

In the third exemplary embodiment of a subpressure limiter 45 shown in FIG. 3, a chamber 46 is connected via a second line 10 to the suction tube section downstream of the throttle valve. The chamber 46 contains a bellows 47 comprising an evacuated elastic hollow body, the upper surface of which is attached to the chamber base and the lower surface is linked to a closure body 48 which, for example, is formed as a truncated cone, and cooperating with a fixed valve seat 49.

The operation of the subpressure limiter depicted in FIG. 3 is as follows:

During the normal running operation and during the idle running operation of the combustion engine the valve element 48,49 is in its closed position. However, during an overrunning operation of the combustion engine, when the suction tube pressure downstream of the throttle valve falls below an absolute value characterizing that overrunning operation, then the bellows 47 expands and lifts the closure body 48 off the fixed valve seat 49, so that air can now reach the suction tube section downstream of the throttle valve via the first line 9 as well as through the second line 10. The opening pressure can, for example, be pre-set by mounting the closure body 48 on a threaded shaft, as shown, thereby permitting the adjustment of the position of the closure body 48 relative to the bellows 47. Alternatively, the bellows 47 can be supported at its other end by a screw, as in the exemplary embodiment according to FIGS. 1 and 2, and thus can be made adjustable in an axial direction. In the exemplary embodiment according to FIGS. 1, 2 and 3, the given opening pressure which triggers the allocation of the overrunning operation air is thus dependent upon a predetermined absolute pressure, and is independent of differing altitudes.

The potential use of the apparatus as embodied in this application with a mechanically controlled fuel injection system is represented in FIG. 4. The combustion air therein flows in the direction of the arrow into a suction tube 50 having a conical section 51 containing an air flow measuring element 52, and further flows through a connecting conduit 53 and an induction tube region 54 which encloses an arbitrarily actuatable throttle valve 55, to one or several cylinders, not here shown, of an internal combustion engine. The air flow measuring element 52 is a plate, oriented transversely to the direction of air flow, which moves within the conical region 51 of the suction tube in a nearly linear function of the air quantity streaming through the suction tube, wherein for a constant restoring force acting upon the air flow measuring element 52 as well as a constant air pressure prevailing upstream of the air flow measuring element 52, the pressure prevalent between the air flow measuring element 52 and the throttle valve 55 likewise remains constant.

The air flow measuring element 52 directly influences a metering and quantity distribution valve assembly 57. The movements of the measuring element 52 are transmitted by an attached lever 58 which pivots about a point 59 and during such pivotal movement a projection 60 provided thereon, as shown, actuates the movable valve element, embodied as a control slide 61, of the metering and quantity distribution valve assembly 57.

Fuel is supplied by a fuel pump 64, driven by an electric motor 63, from a fuel tank 65 and is delivered through a fuel supply line 66 and a channel 67 to an annular groove 68 on the control slide 61. Depending on the position of the control slide 61, the annular groove 68 opens, to a greater or lesser extent, control slits 69, each of which leads through a channel 70 to a chamber 71. Each chamber 71 is separated from a chamber 73 by a diaphragm 72 which serves as the movable part of a flat-seat valve acting as a pressure-equalizing valve. From the chamber 71, the fuel is admitted through injection channels 75 to the individual fuel injection valves (not shown) which are located in the induction tube in the vicinity of the engine cylinders.

From the fuel supply line 66 extends a line 76 in which is disposed a pressure limiting valve 77. When there is excessive pressure in the system, the pressure limiting valve allows fuel to flow back into the fuel tank 65.

The face of the control slide 61 remote from lever 58 is exposed to the force of pressurized fluid which provides a restoring force for the sensor 52 and which exerts its force through a line 79 including a damping throttle 80.

Also extending from the line 66 is a line 82 including, in series, a first throttle 83, the chambers 73 of the pressure-equalizing valves 74, a second throttle 84 and an electromagnetic valve 85. Connected in parallel to the electromagnetic valve 85 is a line 86 containing a third throttle 87 through which the fuel in the control pressure circuit 82 may return to the fuel tank without gauge pressure via the return flow line 88.

The operation of the fuel injection system represented in FIG. 4 is as follows:

When the internal combustion engine is running, air is drawn in through the induction tube 50, 53 and 54 and, as a result, the sensor 52 is displaced from its rest position. In response to the deflection of the sensor 52, the control slide 61 of the fuel metering and distributing valve 57, which meters the quantity of fuel flowing to the injection valves, is displaced by the lever 58. The direct, positive coupling between the sensor 52 and the control slide 61 insures a constant ratio of the quantity of air to the metered-out quantity of fuel.

In order to adapt the fuel-air mixture to particular operating conditions of the internal combustion engine, it may be necessary to vary the pressure difference across the metering valve locations 68,69. The pressure difference across these metering valve locations can be advantageously regulated and varied in common by varying the pressure in the control pressure circuit 82. In the present embodiment, the differential pressure across the metering valve locations 68,69 is varied by changing the differential pressure across the first throttle 83, thereby varying the quantity of fluid flowing through it. This variation of the flow through the first throttle 83 is made possible by the presence, in the control pressure circuit 82, of a second throttle 84 and an electromagnetic valve 85 with a third throttle 87 disposed in parallel thereto, all downstream of the first throttle 83. When the electromagnetic valve 85 is closed, the quantity of fuel flowing through the throttle 83 is determined by the throttles 83, 84 and 87, whereas, when the electromagnetic valve is open, the quantity of fuel flowing in the control pressure circuit is determined by the throttles 83 and 84 alone, resulting in a reduced throttling action and an increased pressure difference across the first throttle 83. As a result, the pressure difference at the metering valve locations 68,69 is also increased. The pressure difference across the first throttle 83 may be changed by varying the ratio of the duration of the open period to the closed period, i.e., by varying the keying ratio or duty factor of the electromagnetic valve 85. When the electromagnetic valve remains closed, the pressure difference is at a minimum and a lean fuel-air mixture is obtained, whereas, when the electromagnetic valve 85 remains open, the pressure difference is at a maximum and the fuel-air mixture is richest.

In order to ensure the correct apportionment of the overrunning operation air, as well as ensuring the correct combustion in the engine at differing altitudes, a subpressure limiter corresponding to the embodiments of the invention shown in FIGS. 1, 2 or 3 is provided in the bypass formed by the lines 9, 10 bypassing the throttle valve 55.

The keying ratio of the electromagnetic valve 85 can be varied, in accordance with a feature depicted in FIG. 5, by means of an electronic control apparatus which can assimilate the output signals of an oxygen probe in addition to the other operational characteristics of the combustion engine monitored by means of appropriate sensors.

The electrically controlled fuel injection system depicted in FIG. 5 is intended for utilization with a four-cylinder, four-cycle internal combustion engine 90, and encompasses as its essential component parts four electromagnetically actuatable injection valves 91 to which fuel to be injected is conducted from a distributing element 92 via respective pipe lines 93, an electrically driven fuel pump 94 which conveys fuel from a container 95, a pressure regulator 96 that maintains the fuel pressure at a constant value, as well as an electronic controller and regulator which is triggered twice for each revolution of the camshaft by means of a signal sender 98 coupled to the camshaft 97 of the internal combustion engine, and which controller then delivers a square electrical opening pulse J for the injection valves 91 each time it is triggered. The depicted time duration t/i of the opening pulses determines the open state duration of the injection valves, and hence determines that given fuel quantity which exits during the given open state duration from the interior of the injection valves 91 experiencing a practically constant fuel pressure of 2 atmospheres. Each of the magnetic windings 99 of the respective injection valves is connected in series with a decoupling resistance 100 and thence is connected to a common amplifier and driver stage of an electronic controller 101 containing at least one driver transistor whose emitter-collector path is in series with the decoupling resistances 100 and with the common unilateral connection of the magnetic windings 99.

In mixture compressing and externally ignited combustion engines as disclosed in FIG. 5, the given fuel quantity is allocated in accordance with the aspirated air quantity that reaches a given cylinder during a single suction stroke which can be completely fired during the subsequent power stroke. It is necessary for an efficient operation of the internal combustion engine that no significant air surplus shall be present subsequent to the power stroke. In order to reach the desired stoichiometric relation between the aspirated air and the allocated fuel, an air quantity metering unit LM is provided in the intake tube 102 of the internal combustion engine downstream of a filter 103 but upstream of the throttle valve 105 that is controlled by means of an accelerator pedal 104. The air quantity metering unit LM comprises essentially a barrier plate 106 as well as a variable resistance R whose movable contact member 107 is coupled to the barrier plate and cooperates with an electronic controller 101 which delivers the injection pulses t/i at its output terminal.

The electronic controller 101 contains two transistors whose operational states are always mutually opposite and which therefore have cross-coupled feedback interconnections, and an energy storage device which can be embodied as a capacitor, although it can instead be embodied as an inductor. The duration of the given discharging process of the energy storage device yields the open state duration t/i for the injection valves. For this reason, the energy storage device must be charged in a definite manner prior to each given discharging process.

To assure that the given discharge duration corresponds directly to the necessary information concerning the air quantity appropriated for the given individual suction stroke, the charging process takes place by means of a charging switch shown in the depicted exemplary embodiment in the form of the signal sender 98 actuated synchronously with the revolutions of the crankshaft. The signal sender 98 causes the repeated interconnection of the energy storage device to a charging source during the charging pulses LJ which extend over a fixed and constant angle of rotation of the crankshaft; the charging source being arranged to deliver a charging current of corresponding given duration during these charging pulses LJ. It shall be assumed in the present case that the signal sender 98, which can include a practical embodiment of a bistable multivibrator toggled to its respective opposing states by means of the ignition pulses, is kept activated during a rotational crankshaft angle of 180 degrees and consecutively kept deactivated during an equal angle of rotation.

In each instance, to assure the correct apportionment of the overrunning operation air, thereby ensuring the correct combustion in the engine, at differing altitudes, a subpressure limiter corresponding to the exemplary embodiments of FIGS. 1, 2 or 3 is provided in the bypass formed by the lines 9, 10 thus bypassing the throttle valve 105. However, the use of the subpressure limiter of this invention is not restricted to fuel injection systems.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A subpressure limiter for a fuel injection system of a mixture compressing, externally ignited internal combustion engine having a suction tube containing an arbitrarily actuatable throttle valve in which an apportioned fuel quantity is injected into the suction tube, the suction tube including suction tube sections upstream and downstream of the flap of the throttle valve wherein the improvement comprises, a bypass for interconnecting said upstream and downstream sections of said suction tube, a subpressure limiter for varying the cross-sectional area of said bypass, said subpressure limiter including a pressure-dependent control element that responds to the subpressure prevailing within the suction tube section downstream of the throttle valve during an overrunning operation, said pressure-dependent control element comprising a control valve, a pre-control capsule, including a pressure-responsive capsule in the form of an evacuated elastic hollow body arranged to actuate said control valve and a chamber connected to said suction tube section downstream of said throttle valve in which said hollow body is confined, a bypass control capsule associated with said control valve, said bypass control capsule comprising a housing provided with first and second chambers and an intermediate diaphragm, the first of said chambers connected to a first line in communication with said suction tube section upstream of the throttle valve, said last named chamber also connected to a second line in communication with said suction tube downstream of said throttle valve, valve means associated with said diaphragm arranged to close said second line, throttling means providing for communication between said first and second chambers and spring means in said second chamber serving to bias said valve means in a closing direction.

2. A subpressure limiter as claimed in claim 1, further wherein said control valve includes a spring loaded assembly having a valve element and seat means arranged to cooperate with said valve element, said valve element being actuated by said pressure dependent control element.

3. A subpressure limiter as claimed in claim 2 wherein said spring loaded assembly include a sleeve member having a surface, and wherein said sleeve member surface serves as a stop means for said evacuated hollow body.

4. A subpressure limiter as claimed in claim 3, further wherein said valve element has a terminal portion that protrudes beyond said surface of said sleeve member.

5. A subpressure limiter as claimed in claim 4 including rigid means on said evacuated hollow body adapted to contact said valve element.

6. A subpressure limiter as claimed in claim 5 wherein said terminal portion of said valve element includes a restraining means, said restraining means being actuated by said rigid means during overrunning of said internal combustion engine.

7. A subpressure limiter as claimed in claim 6 wherein said evacuated hollow body moves said rigid means into contact with said stop means upon a pressure loss in said hollow body.

8. A subpressure limiter as claimed in claim 1 including adjustable means for adjustment of the position of said evacuated hollow body in said chamber.

9. A subpressure limiter as claimed in claim 3 wherein said spring loaded assembly includes at least one element disposed in frictional contact with said sleeve member.

10. A subpressure limiter according to claim 1 including a connecting hose for interconnecting said pre-control capsule and the second chamber of the bypass control capsule.

11. A subpressure limiter according to claim 1 wherein said pre-control capsule includes an audible means, said audible means being arranged to be actuated by an excessively large subpressure during the overrunning operation of said internal combustion engine.

* * * * *